United States Patent [19]

Marinescu

[11] 4,395,693

[45] Jul. 26, 1983

[54] ELECTRICAL WINDING FOR A TRANSFORMER, A CHOKE COIL OR THE LIKE

[75] Inventor: Marlene Marinescu, Frankfurt am Main, Fed. Rep. of Germany

[73] Assignee: Teldix GmbH, Heidelberg, Fed. Rep. of Germany

[21] Appl. No.: 276,350

[22] PCT Filed: Oct. 16, 1980

[86] PCT No.: PCT/DE80/00150

§ 371 Date: Jun. 9, 1981

§ 102(e) Date: Jun. 9, 1981

[87] PCT Pub. No.: WO81/01219

PCT Pub. Date: Apr. 30, 1981

[30] Foreign Application Priority Data

Oct. 25, 1979 [DE] Fed. Rep. of Germany ..... 2943124

[51] Int. Cl.[3] ..... H01H 85/00

[52] U.S. Cl. ..... 336/223; 336/187; 336/232

[58] Field of Search ..... 336/186, 187, 223, 232; 29/605; 174/33, 34, 88 B

[56] References Cited

U.S. PATENT DOCUMENTS

| | | | |
|---|---|---|---|
| 1,629,462 | 5/1927 | Palueff | 336/187 |
| 2,310,684 | 2/1943 | Farry | 336/187 |
| 3,256,417 | 6/1966 | Merrett | 336/187 X |
| 3,280,244 | 10/1966 | Pannen | 174/34 |
| 3,467,931 | 9/1969 | Dutton | 336/187 X |
| 3,546,644 | 12/1970 | Wilburn et al. | 336/223 |
| 3,587,169 | 6/1971 | Benke et al. | 336/187 X |
| 3,633,272 | 1/1972 | Benke et al. | 336/187 X |
| 3,633,273 | 1/1972 | Wilburn et al. | 29/605 |
| 3,691,496 | 9/1972 | Beavo | 336/187 X |
| 4,262,163 | 4/1981 | Durrell et al. | 336/187 X |

FOREIGN PATENT DOCUMENTS

| | | | |
|---|---|---|---|
| 6411467 | 7/1928 | France | 336/187 |
| 93596 | 11/1972 | German Democratic Rep. | 336/223 |

*Primary Examiner*—A. T. Grimley

*Attorney, Agent, or Firm*—Spencer & Kaye

[57] ABSTRACT

The invention relates to an electrical winding for a transformer, a choke coil or the like, particularly for high frequencies, wherein the conductor forming the winding is radially subdivided into n subconductors and within the winding the subconductors are twisted in such a manner that the initially innermost subconductor, after twisting comes to lie outermost, the subconductor in the second innermost position, after twisting comes to lie at the second outermost position, etc. If the subconductors are designed as conductor tapes, the subconductors 1 through (n−1) comprise two partially overlapping tape sections which in the overlap region are conductively connected together at the side edges of the tape, the $n^{th}$ conductor tape being made of one piece and forming one of the outwardly disposed subconductors of the conductor.

The conductor tapes 2 through n are laced through between the overlapping tape sections of the first subconductor, the conductor tapes 3 through n are laced through between the overlapping tape sections of the second subconductor, the $n^{th}$ tape being laced through between the overlapping tape sections of the $(n-1)^{th}$ conductor.

4 Claims, 5 Drawing Figures

ELECTRICAL WINDING FOR A TRANSFORMER, A CHOKE COIL OR THE LIKE

BACKGROUND OF THE INVENTION

1. Field of the Invention

The invention relates to an electrical winding for a transformer, a choke coil or the like wherein the conductor forming the winding is subdivided in the radial direction into n subconductors and, within the winding, the subconductors are twisted in such a manner that the initially innermost subconductor, after twisting, becomes the outermost subconductor, the second most inwardly disposed subconductor, after twisting, becomes the second most outwardly disposed subconductor, etc.

2. Description of the Prior Art

It is known from German Pat. No. 902,042 and from Richter, "Electrical Machines III", published by Birkhauser Verlag, 1963, pages 208–209, to subdivide in the radial direction the conductor forming the winding and in the course of the winding twist the subconductors in such a manner that the initially outermost subconductor, after twisting, comes to lie innermost, the subconductor initially lying in the second most outward position, after twisting, comes to lie at the second most inward position, etc. In both cases, the reason for doing this is stated to be a reduction of eddy current losses.

It is the object of the invention to provide a tape winding in which a plurality of superposed tapes, whose ends are connected electrically in parallel, form the conductor with such twisting that the winding operates essentially without losses.

SUMMARY OF THE INVENTION

This problem is solved in that during forming of the subconductors into conductor tapes, the subconductors 1 through (n−1) include two partially overlapping tape sections which are conductively connected together at their lateral edges in the overlap region, that the $n^{th}$ conductor tape is made of one piece and forms one of the outwardly disposed subconductors of the conductor, that the conductor tapes 2 through n are laced through between the overlapping tape sections of the first subconductor, that the conductor tapes 3 through n are laced through between the overlapping tape sections of the second subconductor, etc. until finally, the $n^{th}$ tape is laced through between the overlapping tape sections of the $(n-1)^{th}$ conductor.

In order to avoid excess "bulk" in the winding at one point, the regions of overlap are preferably offset somewhat with respect to one another in the direction of winding.

Favorably, the region of overlap is selected of such a width that the conductive connection between the overlapping tape sections corresponds approximately to the width of the conductor and thus there will be no significant increase in ohmic resistance due to the configuration of the tapes.

The basic idea of the conductor design can be realized in practice in various ways. In one possible way, two tape sections are permitted to overlap during the production of the first through $(n-1)^{th}$ conductor tapes and these two tape sections are connected along one lateral edge of the tape in the overlap region.

According to another possible solution, the first through $(n-1)^{th}$ conductor tape are initially folded about an edge which is inclined by 45° with respect to the winding direction; then the folded portion is folded again in a further fold about an edge inclined by 45° with respect to the direction of winding so that the folded conductor tape again extends in the winding direction, but is offset by about one tape width, finally, by folding the offset portion about the lateral edge of the tape in the overlap region back into the path of the winding, the desired tape configuration is realized.

According to a third possibility, the first through $(n-1)^{th}$ conductor tapes are each produced in that in a tape of double width two regions are produced, by cutting away or the like of one-half a tape width, with the conductor tapes offset with respect to each other by one tape width. These two regions must in part overlap and then the one tape region is folded by 180° in the direction of winding about the edge connecting the two regions.

In all three cases, a continuous conductor tape is produced which, however, in the overlap region permits other tapes to change from one side of the tape to the other. The latter method has the advantage that it can be produced by folding and does not add much bulk, particularly, if the overlap regions are additionally offset with respect to one another. However, this method requires a relatively large amount of copper.

According to a further feature of the invention, the point of twisting of the individual subconductors is placed at least in the vicinity of the point on the length of the winding where the fluxes through the surface areas of the partial loops are identical. With such an arrangement of the point of twisting, it is accomplished that the currents generated by axial flux in the individual loops make no or only a small contribution to the losses. Thus, this measure is of particular interest, for example, for transformers having a high degree of efficiency. This dimensioning is not limited to tape windings.

BRIEF DESCRIPTION OF THE DRAWINGS

Embodiments of the invention will be explained with the aid of the drawings, wherein.

DESCRIPTION OF THE PREFERRED EMBODIMENTS

Figure 1:
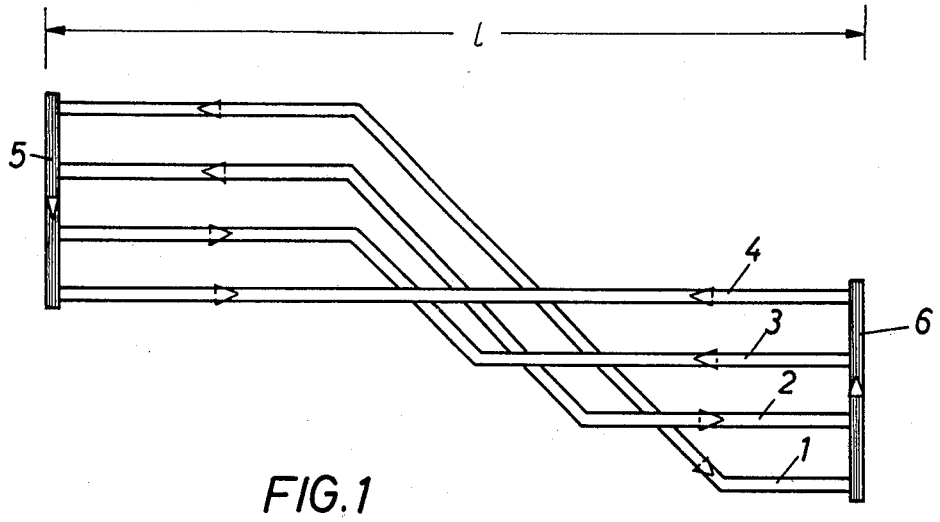
FIG. 1 shows a twisted conductor including four subconductors.

FIG. 1 shows, in its unwound state, the conductor of an electrical winding of length l composed of four mutually insulated conductors 1–4. The subconductors are short-circuited at their ends 5 and 6. The subconductors 1–4 are twisted in such a manner that the subconductor 1 initially lies at the uppermost position and later at the lowermost position, conductor 2 initially lies at the second position from the top, later at the second position from the bottom, etc. This reduces losses.

If the winding is designed as a tape winding, the subconductors 1–3 must permit the changeover of other subconductors from one side of the tape to the other while the subconductor 4 is designed as a continuous tape. This is shown in principle in FIG. 2 which shows the four subconductors 1–4 in a top view seen toward the side edges. However, in order to illustrate the invention, it was necessary to distort the axis perpendicular to the conductor. It can be seen that the subconductor 1 (solid line) is initially at the top, later at the bottom. The subconductor has an overlap region 7 in which the two separately illustrated parts of the subconductor 1 are connected together at their lower edges. This connection is shown by hatching, however in the distorted illustration. The connection is formed by the edge and not —as shown—by an area. In reality, the parts of the subconductor 1 lie on top of one another in the overlap region unless other subconductors are laced through. Between the two parts of the subconductor 1, the other three conductors 2–4 change toward the other side of the tape. The width of the connection of the two conductor parts, i.e. of the overlap region, corresponds to the width of the tapes.

Figure 3:
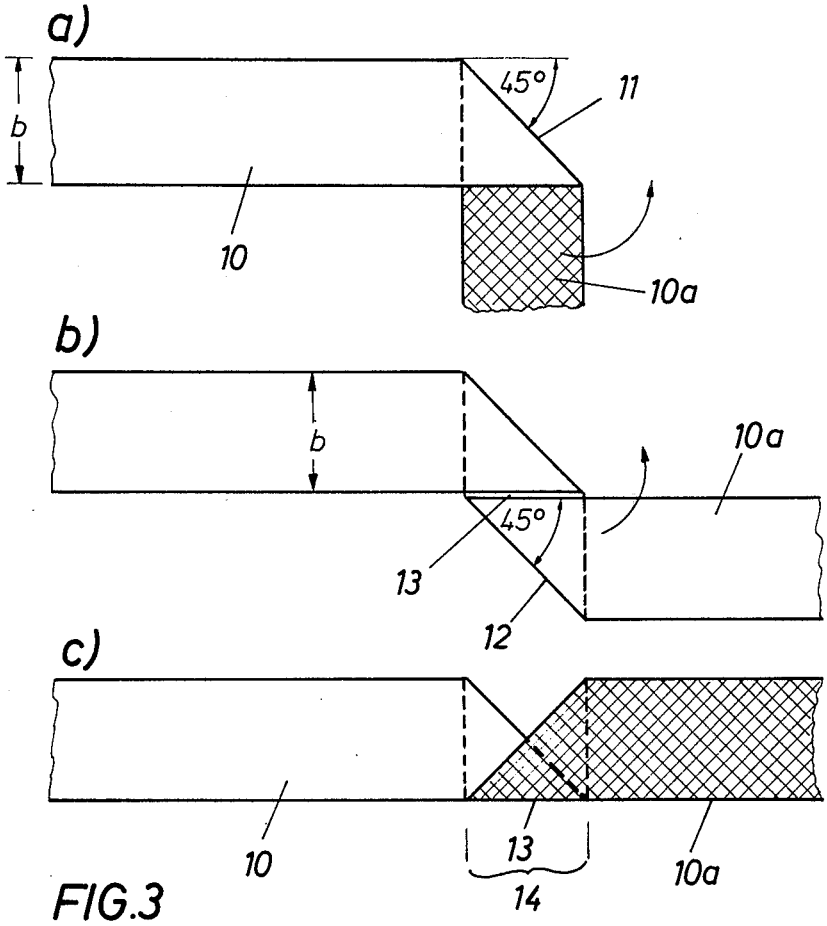
FIG. 3 illustrates an embodiment showing the configuration of the individual tapes.

The subconductors 2 and 3 (shown in dash-dot or dashed line, respectively) are constructed in the same manner. Through them, conductors 3 and 4 or only 4, respectively, change over to the other side of the tape. The overlap regions 7–9 are somewhat offset with respect to one another. The conductor 4 (shown by a dotted line) is a continuous tape. In the overlap region, the subconductors 1–3, according to the embodiment of FIG. 3, are produced in such a manner that initially the subconductor 10 is folded about an edge 11 (FIG. 3*a*), then the folded portion 10*a* is again folded about an edge 12 inclined by 45° so that the folded portion 10*a* is offset by about the width b with respect to part 10 and finally part 10*a* is folded back about edge 13 to produce the desired subconductor. The overlap region is here identified with the numeral 14.

Figure 4:
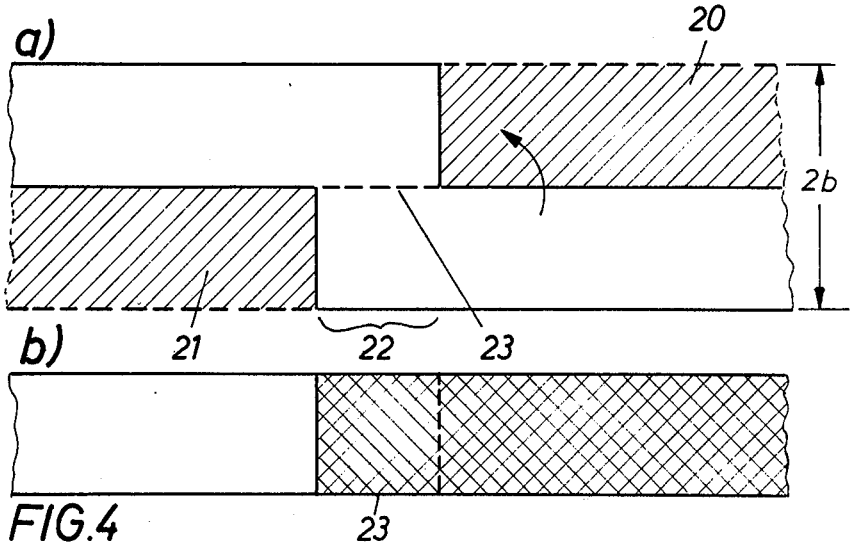
FIG. 4 depicts a second embodiment showing the configuration of the individual tapes.

According to FIG. 4, a conductor having two regions offset by b and the overlap region 22 is formed of a conductor tape of the width 2*b* by severing the parts 20 and 21 (FIG. 4*a*). Folding about the edge 23 then produces the conductor (FIG. 4*b*).

The same configuration as in FIG. 4*b* will also result for the conductor if two separate tape sections are placed on top of one another in the overlap region and are conductively connected at edge 23.

Figure 5:
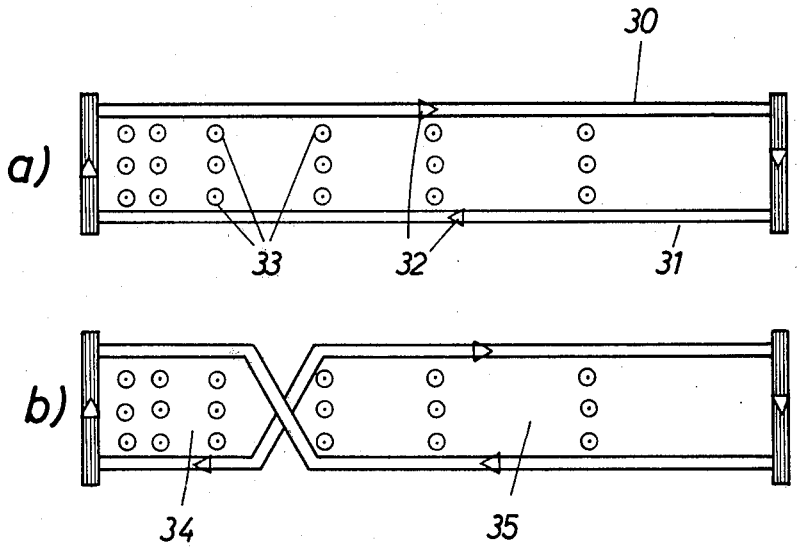
FIG. 5 is a basic sketch for determining the position of the point of twisting.

For a conductor formed of two subconductors 30 and 31, FIG. 5*a* shows by way of circles 33 the distribution of the magnetic flux penetrating the loop. The resulting current which causes considerable losses is indicated by arrows 32.

Figure 2:
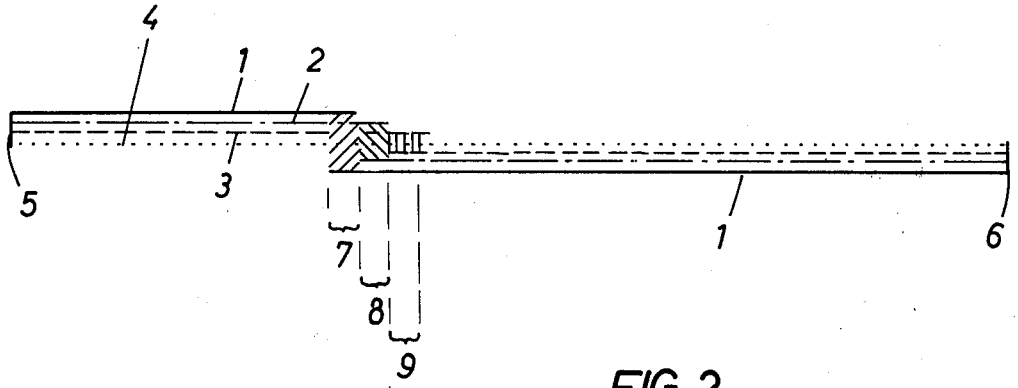
FIG. 2 is a basic diagram of the path of the tape sections of the present invention showing a top view onto the lateral edges of the tape.

If the twist is placed so that the total flux through loop sections 34 and 35 is identical, the currents generated in the loop sections 34 and 35 are compensated and losses are avoided. This teaching can also be employed in an arrangement having four conductors as shown in FIG. 2, but then the overlap regions 7–9 must be placed in the vicinity of the respective point on the length of the conductor. This is shown in FIG. 2 by the asymmetrical position of the overlap regions on the length of the conductor. The exact position of the point depends on the leakage flux curve in the given magnetic circuit, which may be different from case to case. Normally, it can be assumed, however, that the leakage flux of interest decreases practically linearly from the surface of the winding toward the magnetic yoke to there become equal to zero. With this prerequisite, the point of twisting lies at about 30% of the conductor length l, measured from the end of the winding disposed in the area of intensive leakage flux.

I claim:

1. An electrical winding having a conductor which is radially subdivided into 1 through n subconductor tapes, and wherein within the winding said subconductor tapes are twisted in such a manner that the tape initially lying innermost, after twisting, comes to lie outermost, the tape lying at the second innermost position, after twisting, comes to lie at the second outermost position, etc., wherein the improvement comprises that the subconductor tapes 1 through (n−1) are formed of two partially overlapping tape sections which in the overlap region are conductively connected together at the side edges of the tape sections; that the $n^{th}$ subconductor tape is made of one piece and forms one of the outwardly disposed subconductor tapes of the conductor; that the subconductor tapes 2 through n are laced through between the overlapping tape sections of the first subconductor tape; that the conductor tapes 3 through n are laced through between the overlapping tape sections of the second subconductor, the $n^{th}$ tape being laced through the overlapping tape sections of the $(n-1)^{th}$ conductor, each of the first through $(n-1)^{th}$ conductor tapes being produced from a double width tape wherein two regions are formed by severing half the tape width, the conductor tape extending in said region being offset with respect to itself by one tape width and said regions overlapping in part, one tape region being folded about the side edge of the tape by 180° in the overlap region.

2. An electrical winding according to claim 1, wherein the overlap regions of the subconductor tapes are somewhat offset with respect to one another in the direction of winding.

3. An electrical winding according to claim 1, wherein the width of the conductive connection between overlapping tape sections corresponds approximately to the width of the tape.

4. An electrical winding according to claim 1, wherein the points of twisting, particularly the overlap regions of the individual subconductors, lie at least in the vicinity of the point on the length of the winding at which the fluxes in the loop areas of the thus formed loops are identical.

* * * * *